US005271579A

United States Patent [19]

De Luca

[11] Patent Number: 5,271,579

[45] Date of Patent: Dec. 21, 1993

[54] RECREATIONAL AND SPORT ROCKET CONSTRUCTION

[76] Inventor: Nicholas J. De Luca, 721 E. Cordova St. #1, Pasadena, Calif. 91101

[21] Appl. No.: 911,474

[22] Filed: Jul. 10, 1992

[51] Int. Cl.[5] ..... F42B 10/12

[52] U.S. Cl. ..... 244/3.24; 102/348; 244/90 R; 244/3.26; 273/416; 446/66

[58] Field of Search ..... 102/347, 348, 355, 388; 244/45 A, 90 R, 212, 215, 3.24, 3.26, 3.27, 3.28, 3.29, 3.23; 273/416; 446/56, 66, 211, 212

[56] References Cited

U.S. PATENT DOCUMENTS

| | | | |
|---|---|---|---|
| Re. 26,882 | 5/1970 | Turner | 273/416 |
| 2,876,585 | 3/1959 | Zaic | 446/66 |
| 3,091,889 | 6/1963 | Zaic | 446/66 |
| 3,888,178 | 6/1975 | Senoski | 102/348 |
| 3,903,801 | 9/1975 | Senoski | 102/348 |
| 3,942,441 | 3/1976 | Senoski | 102/348 |
| 5,139,215 | 8/1992 | Peckham | 244/3.24 |

*Primary Examiner*—Harold J. Tudor
*Attorney, Agent, or Firm*—George J. Netter

[57] ABSTRACT

A recreational rocket (10) has a nose cone assembly (18,33) movable with respect to the main rocket body 12 between two limits. Each of a pair of fins (20) on the nose cone assembly (18,33) has a hinged aileron (22). The ailerons (22) are held in a straight path course by a limit bar (37) on body (12) when the nose cone assembly is at one limit. Plastic members (42) pull the ailerons (22) into glide mode position against the edges of stanchion plates (38).

4 Claims, 1 Drawing Sheet

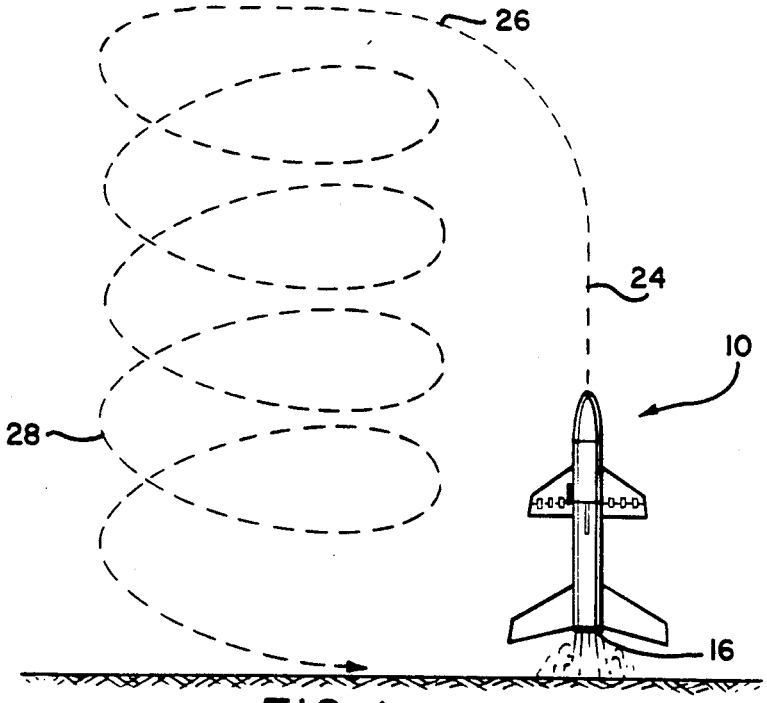
FIG. 1
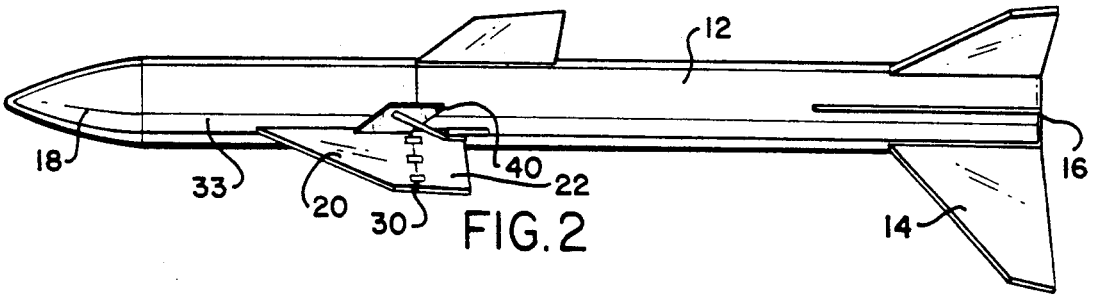
FIG. 2
FIG. 3
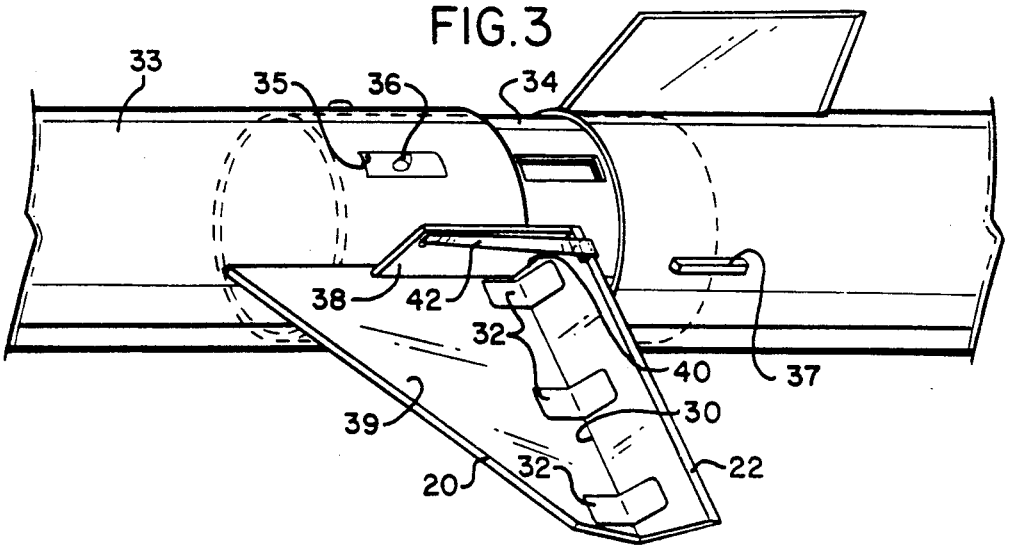

RECREATIONAL AND SPORT ROCKET CONSTRUCTION

BACKGROUND

1. Field of the Invention

The present invention relates generally to a recreational and sport rocket, and, more particularly, to means carried by the rocket during flight for converting missile flight into a glide mode after the rocket reaches its maximum altitude.

2. Description of Related Art

A sport and recreation of ever increasing popularity is that of building and flying model rockets. These rockets consist of generally an elongated tube-like body having one or more stabilizing and guide fins or ailerons and powered by a conventional rocket motor; Aerodynamically, these rockets are designed in order to stabilize the operation for a relatively straight (actually ballistic) line of flight such that when they are fired from a vertical launch position, they will achieve a maximum height and then fall back rapidly to the ground along a generally vertical path. If the rocket is fired at an angle other than vertical launch orientation, the result is still very much the same, that the rocket on exhausting its boost powers returns to the ground very rapidly and in a manner that could either destroy the rocket upon impact with the ground or cause damage to persons or property in the vicinity.

It is, therefore, desirable to have the rocket return to the ground at a much slower speed so that upon landing it will not strike the ground with sufficient force to damage the rocket or if it were to strike personal property or an individual, it would be going at such a slow rate as not to produce injury. A common approach to this problem in the past has been the use of parachutes that are released at the maximum height position and allow the rocket to float back to a ground at a slower and safer speed.

SUMMARY OF THE INVENTION

The rocket of the present invention includes a generally elongated tubular body with fins at the aft end adjacent the rocket motor, and a nose cone portion which is slidably mounted onto the opposite end of the rocket body and having a set of additional guide fins with adjustable ailerons. The ailerons are restrained during launch mode so as to induce a straight path course for the rocket. On reaching the end of the boost, an eject.-ion blast takes place which causes the nose cone to move forward and release the ailerons from the normal straight course orientation enabling them to be moved by spring elements to an orientation which will induce glide of the rocket for the return trip to the ground.

BRIEF DESCRIPTION OF THE DRAWING

In the accompanying drawing:

FIG. 1 shows a schematic side elevation view of a rocket of the present invention and its course during flight;

FIG. 2 is a side elevational view of the rocket nose cone and adjacent parts shown with fins and aileron in boost orientation; and FIG. 3 shows a side elevational sectional view of the nose cone in forward position after eject blast showing the aileron adjusted to a glide mode for the rocket.

DESCRIPTION OF A PREFERRED EMBODIMENT

Turning now to the drawings and particularly FIG. 1, a recreational and sport rocket with which the invention to be described is most advantageously employed is identified generally as 10. More particularly, the rocket includes an elongated tubular body 12 with guide fins 14 at what is the aft end of the rocket closely adjacent an axially mounted rocket or boost motor 16. The forward end of the rocket includes a nose cone 18 which is slidingly received upon the forward end of the tubular body 12 and has a further pair of guidance fins 20 which, in a way that will be more particularly described, have ailerons 22 that are positionable into two different modes, namely, a first or boost mode in which the ailerons act to maintain the rocket on a predetermined relatively straight course and a second position for glide mode. Still referring to FIG. 1, on igniting the motor 16 the rocket 10 climbs on a relatively vertical path 24 until it reaches a maximum height 26 at which time an eject blast is set off that causes the nose cone to move forward and apparatus to be described automatically resets the ailerons 22 to a glide path mode of operation for the rocket to return to the ground identified by the spiral line 28.

With reference now to FIG. 2, it is seen that each of the fins 20 are provided with a separate aileron 22 that is pivotally secured to the trailing edge 30 of the fin by a plurality of flexible pads or hinges 32, for example. The fins 20 are secured to the outer surface of the nose cone 18 at opposite sides of the nose cone with the two fins lying in a dihedral configuration. The ailerons extend beyond the inner end edge of a cylindrical fuselage portion 33 immediately adjacent the nose cone and are rotatable about the edge pivot line 30.

The cylindrical fuselage portion 33 has an internal diameter such as to enable sliding receipt upon the end portion of a smaller coupler tube 34 fitted within the end of body 12 and includes a slot 35 through which a pin 36 secured to the coupler tube extends for limiting the amount of axial movement of the fuselage portion 33 and nose cone 18 with respect to the body and preventing them from inadvertently coming loose from the tubular body during flight or during the eject blast.

As can be seen best in FIG. 2, when the nose cone and fuselage portion 33 are fully seated onto the coupler tube 34, the innermost edge portion of an aileron abuts against the side of a limit bar 37 secured to the outer surface of the tubular body. Specifically, the limit bar is positioned so as to maintain the aileron in the plane of the fin 20 on which the aileron is pivotally attached.

A stanchion plate 38 has one edge securely affixed to what will be the lower major surface 39 of a fin 20 when the rocket is in glide mode with the general plane of the plate lying parallel to the nose cone axis and spaced slightly inwardly from the inner edge of the fin. The plate edge 40 which faces toward the rocket engine end of the tubular body 12 is located just inwardly of the pivot line 30 between the aileron and the fin to which it is secured.

A length of an elastic member 42 has one end secured to the outer edge of the aileron and the other end secured to a side surface of the stanchion plate 38. Also, as shown in FIG. 2, when the aileron is located against the limit bar 37 (for straight line course operation of the rocket), the elastic member is stretched and, therefore, in tension.

With the fins 20 located to the rear on the nose cone and fuselage portion 33 being fully seated on the rocket coupler tube 34 and the aileron in locked position against the limit bar 37 as shown in FIG. 2, the rocket is now in condition for operation in launch mode. On igniting the rocket motor 16, the rocket will move upwardly in a generally vertical direction as shown in FIG. 1 until it reaches the maximum point 26 at which time the rocket engine is at burnout and the rocket begins return to earth. An eject blast is initiated by means.(not shown) that drives the nose cone forward and axially away from the tubular body 12 but does not disengage the same, merely locating it to the limit provided by the pin 36. At this time, the aileron moves forward and beyond contact with the limit bar 37 and as a result of the tensile force in the elastic member 42, the aileron pivots and is positioned against the end of the stanchion plate 38 as shown in FIG. 3. This new position is such as to cause the rocket to assume a glide path with the fin major surface 39 facing the ground, rather than merely dropping nose down at a high rate of speed.

Although the present invention has been described in connection with a preferred embodiment, it is understood that those skilled in the appertaining arts may contemplate modifications that come within the spirit of the invention as described and within the ambit of the appended claims.

What is claimed is:

1. A flight course control means for a recreational rocket comprising:

a body;

a nose cone assembly axially slidably relative to an end portion of the body between two limit stops;

first and second ailerons pivotally mounted on opposite sides of the nose cone assembly;

limit bar means mounted to the body for engaging and maintaining the ailerons in a first flight course control position when the nose cone assembly is at a first of said limit stops;

limit plate means mounted on the nose cone assembly; and elastic member means interrelating the ailerons with respect to the limit plate means and in tension when the ailerons are in the first flight control position; and when the nose cone assembly is moved to the other limit stop, the ailerons moves away from the limit bar means and are pulled by the elastic member means into a different flight course control position.

2. A flight course control means as in claim 1, in which there is further provided first and second guide fins secured to an outer surface of the nose cone assembly at opposite sides and the ailerons are each pivotally connected to a respective edge of a guide fin.

3. A flight course control means as in claim 2, in which the limit plate means are secured to an outer surface of each guide fine, and the ailerons move into contact with the limit plate means when the nose cone assembly moves forwardly away from the body.

4. A flight course control means as in claim 1, in which the elastic member means consists of a strip of rubber.

* * * * *